US006370816B1

(12) United States Patent
Rosato

(10) Patent No.: US 6,370,816 B1
(45) Date of Patent: Apr. 16, 2002

(54) NESTING CHRISTMAS TREE STAND

(76) Inventor: Leo Rosato, 2452 Fairmile Road, R.R. #4, Kemptville Ontario (CA), K0G 1J0

( * ) Notice: Subject to any disclaimer, the term of this patent is extended or adjusted under 35 U.S.C. 154(b) by 17 days.

(21) Appl. No.: 09/666,270

(22) Filed: Sep. 20, 2000

Related U.S. Application Data

(60) Provisional application No. 60/155,564, filed on Sep. 24, 1999.

(51) Int. Cl.[7] ..... F16M 13/00
(52) U.S. Cl. ..... 47/40.5; 248/524
(58) Field of Search ..... 47/40.5; 248/524; 206/515, 519

(56) References Cited

U.S. PATENT DOCUMENTS 4,279,063 A * 7/1981 Joseph ..... 24/562
4,571,881 A * 2/1986 Lathim ..... 47/40.5
4,884,363 A * 12/1989 Sofy ..... 47/40.5
4,976,411 A * 12/1990 Gordon et al. ..... 248/524
5,000,414 A * 3/1991 Rosato ..... 248/524
D321,839 S 11/1991 Rosato
5,121,897 A * 6/1992 Sofy ..... 248/527
5,743,505 A * 4/1998 Sofy ..... 248/346.01
6,299,124 B1 * 10/2001 Reback et al. ..... 248/519

* cited by examiner

*Primary Examiner*—Charles T. Jordan
*Assistant Examiner*—Jordan M. Lofdahl
(74) *Attorney, Agent, or Firm*—Ingrid E. Schmidt

(57) ABSTRACT

A tree stand having an inner well to contain water and an outer peripheral skirt for buttressing the well has pins which slide to engage a tree in the well. Access openings are provided in the peripheral skirt through which the pins of nested tree stands may penetrate so that a plurality of stands may be vertically stacked.

10 Claims, 8 Drawing Sheets

NESTING CHRISTMAS TREE STAND

This application claims priority from provisional U.S. application number 60/155,569 filed on Sep. 24, 1999.

FIELD OF THE INVENTION

This invention relates to a Christmas tree stand which features an inner well to contain water for sustaining the tree and an outer peripheral skirt which buttresses the well and supports the load of the stand containing the tree and water.

BACKGROUND OF THE INVENTION

A Christmas tree stand of the aforementioned kind, pre-assembled with hardware for locating and supporting a tree, is fully described in applicant's U.S. Pat. No. 5,000,414. Because the stand is supplied in a fully assembled state, it has not been possible to nest a plurality of stands so that they can be stacked during shipping or at the point of sale. The hardware provided for supporting the tree is such that it may be difficult to assemble by a consumer and in order to use the Christmas tree stand to its full advantage, it is desirable to provide the stand with the hardware already assembled.

An object of this invention is to provide a Christmas tree stand of the kind defined in U.S. Pat. No. 5,000,414 which can also be nested so that less volume will be required during storage, shipping and at the point of sale.

SUMMARY OF THE INVENTION

In accordance with the invention, access means are provided in the outer peripheral skirt of the tree stand through which the hardware of nested stands may penetrate. The access means may take the form an opening extending longitudinally along a portion of the height of the peripheral skirt between a locating pin forming part of the hardware and a perimetric edge of the skirt. The shape of the opening may vary as shown in the accompanying drawings. Preferably, one end of the opening remote from the associated pin is greater in diameter in order to accommodate a knob which is normally provided for manipulating the locating pins.

In an alternative embodiment of the invention, the opening takes the form of an open slot which extends through the perimetric edge of the skirt and thereby defines legs in the skirt.

In a third embodiment of the invention, the legs defined by an open slot for accommodating the support pins are strengthened by providing a connecting web between the legs and which is shaped to allow clearance for pins and knobs during stacking of the tree stand.

BRIEF DESCRIPTION OF THE DRAWINGS

In order to better understand the invention, preferred embodiments are described below with reference to the accompanying drawings, in which.

DETAILED DESCRIPTION WITH REFERENCE TO THE DRAWINGS

Figure 1:
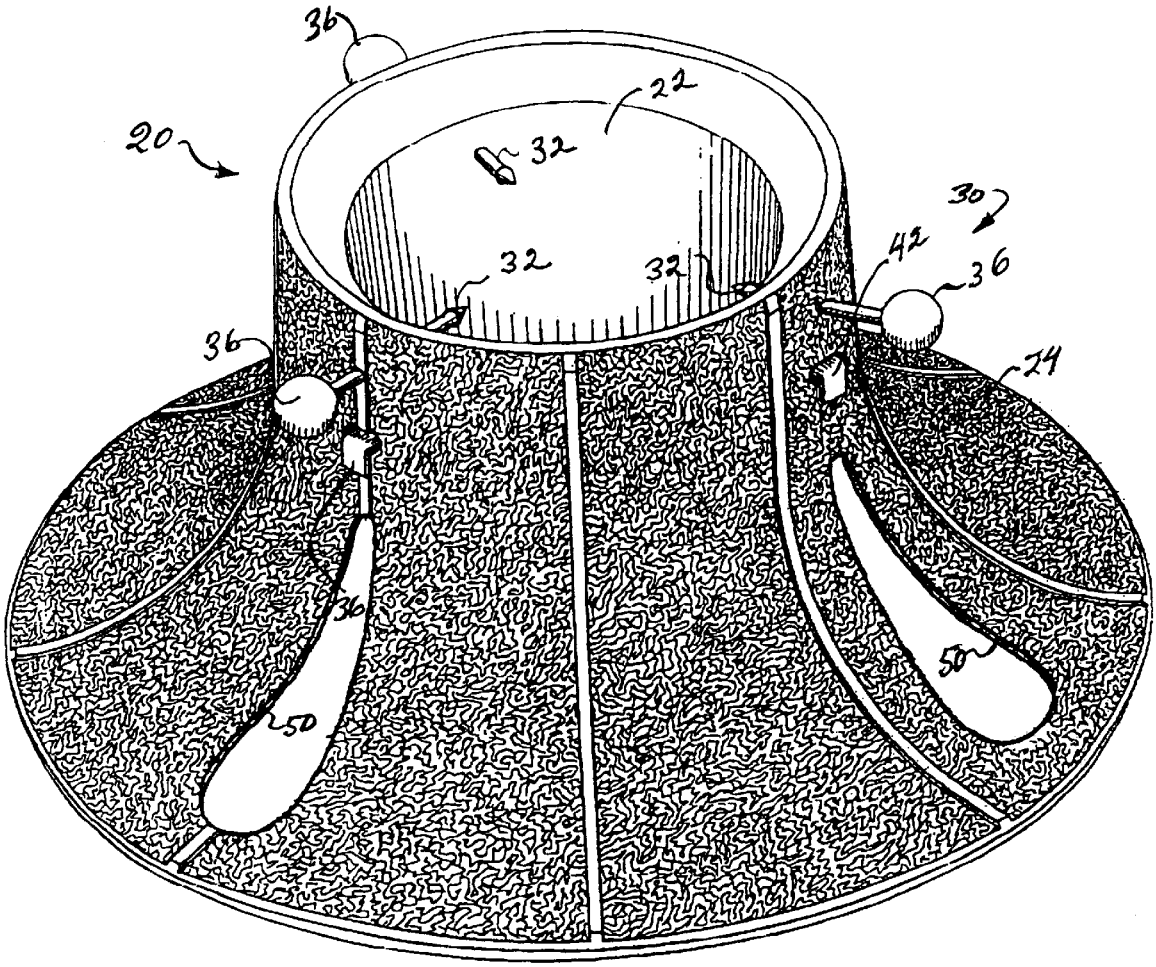
FIG. 1 is a perspective view of a tree stand made in accordance with the invention.

A tree stand made in accordance with the invention is generally indicated in FIG. 1 by reference numeral 20. The tree stand 20 is characterized by an inner well 22 which is closed at one end and, in use, contains water for sustaining a tree (not shown). An outer peripheral skirt 24 is adapted to buttress the well and support the load of the stand 20 containing the tree and water for sustaining the tree. It will be seen that the skirt 24 is contiguous with the well 22 at its upper end and is radially spaced from the well 22 at its lower end.

Figure 3:
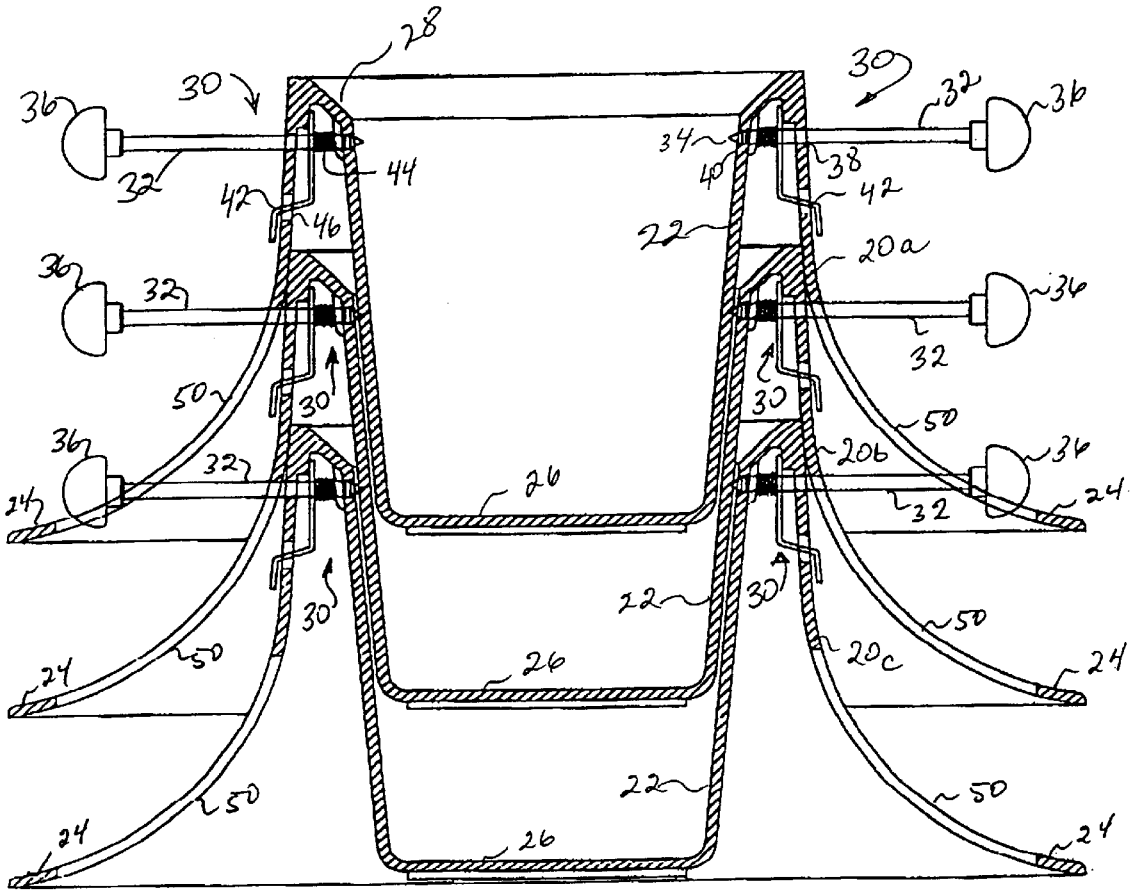
FIG. 3 is a cross-sectional view drawn on line 3—3 of FIG. 2.

The well 22 has a tapered shape so that it has a smaller diameter at a bottom 26 for the well than at an open top 28 for the well (FIG. 3). The tree stand 20 can therefore be nested into other stands such that the well 22 of a first stand 20*a* may be disposed inside the well 22 of a lower, stand 20*b* while the peripheral skirt 24 of the second stand 20*b* will be accommodated between the well 22 and peripheral skirt 24 of the first stand 20*a*. Similarly, the well 22 of the second stand 20*b* will be received inside the well 22 of a third stand 20*c* while the skirt 24 of a third stand 20*c* will be accommodated at its upper end between the skirt 24 and the well 22 of the second stand 20*b*.

The tree stand 20 is provided with hardware generally indicated by reference numeral 30 and which comprises a number of locating pins 32 having a sharp inner end 34 which extends through the wall of well 22 near the top 28 of the well and a knob 36 at an outer end of the pin 32 for manipulating the pin to slide into and out of the well between a retracted configuration spaced from a tree received in the well and an extended configuration engaging the tree. The pins 32 extend through both the peripheral skirt 24 and the inner well 22 through respective openings 38, 40 and are secured in place by a lever 42 and a spring coil 44 disposed on the pin 32 between the well 22 and the lever 42. The lever 42 extends through an opening 46 provided in the peripheral skirt 24 so that it may be manipulated to compress the spring coil 44 and release the associated pin 32 or the lever may be released so that the coil spring 44 will bias the lever 42 into engagement with the pin 32 and lock the pin into position. The operation of the hardware and variants of this hardware are fully described in applicant's U.S. Pat. No. 5,000,414, the disclosure of which is herein incorporated by reference.

It will be appreciated that with the hardware 30 assembled to the tree stand 20, some accommodation must be provided for the locating pins 32 during stacking of the tree stand.

In accordance with the improvement made to the tree stand by this invention, such accommodation takes the form of a number of openings 50 each associated with a respective locating pin 32. In the tree stand 20 of FIG. 1, there are three locating pins 32 and therefore three such openings 50. Each opening 50 has a tear drop shape which extends longitudinally from just below the hardware 30 toward the peripheral edge of the skirt 24 and is adapted to accommodate the pins 32 and terminal knobs 36 of underlying, nested tree stands so that a plurality of stands may be vertically stacked.

Figure 2:
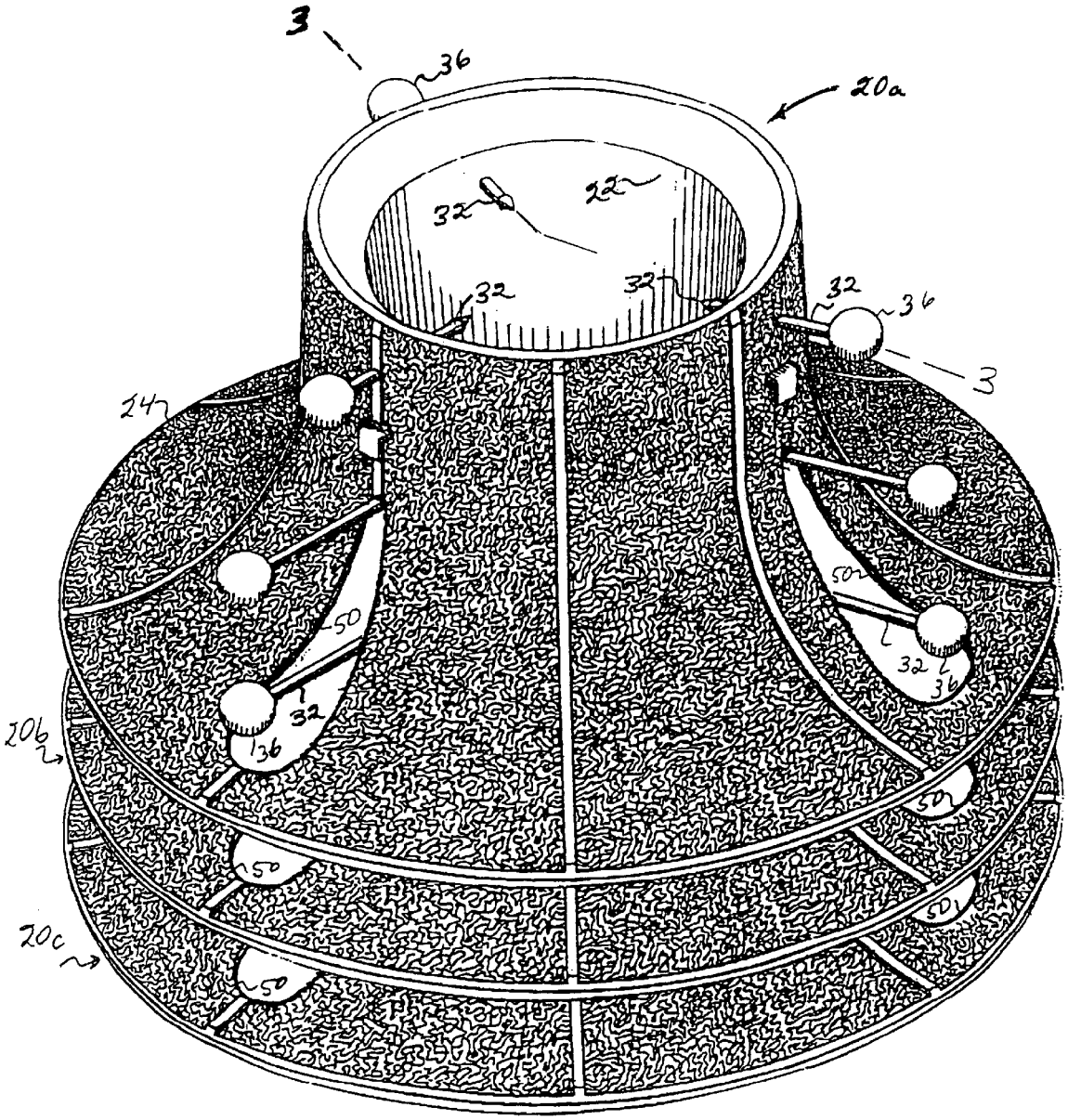
FIG. 2 is a similar view to FIG. 1 showing three tree stands in a nested configuration.
Figure 4:
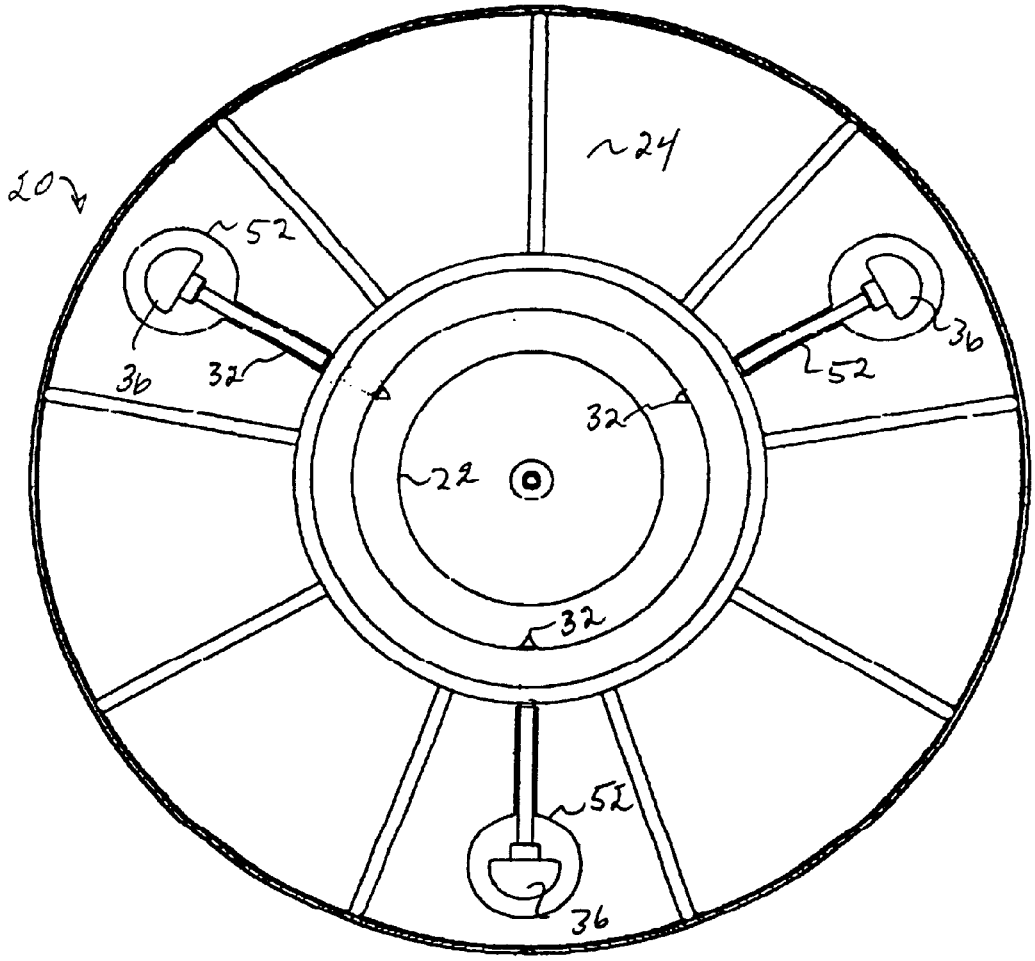
FIG. 4 is a top plan view of a variant of FIG. 1, showing a second embodiment of the invention.
Figure 5:
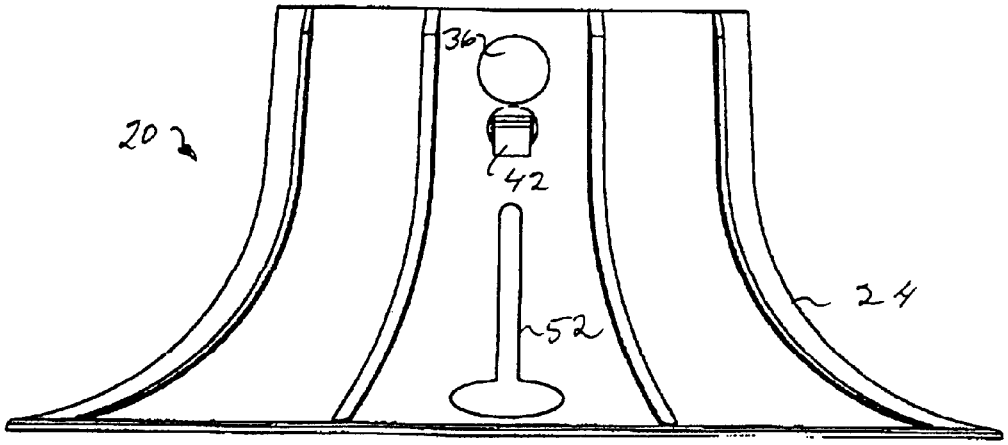
FIG. 5 is a side elevation view of the tree stand of FIG. 4.

In a second embodiment of the invention drawn in FIGS. 4 and 5, and where like reference numerals have been used to identify similar parts to those shown in the embodiment of FIGS. 1 to 3, an access opening for accommodating pins 32 is identified by reference numeral 52 and has the form of a keyhole slot comprising a longitudinally extending narrow opening which terminates in a circular opening adjacent to the peripheral edge of the skirt 24.

Figure 6:
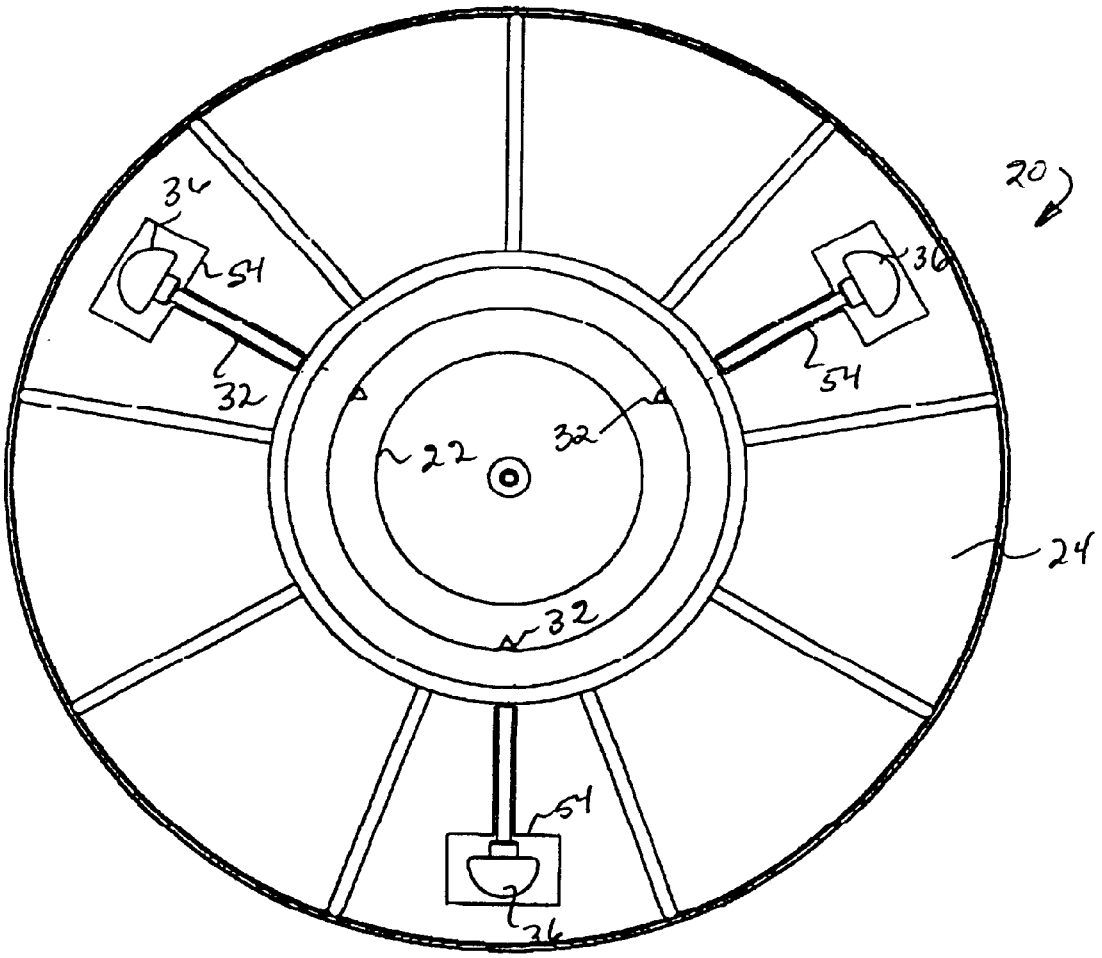
FIG. 6 is a top plan view of a second variant of FIG. 1, showing a third embodiment of the invention.
Figure 7:
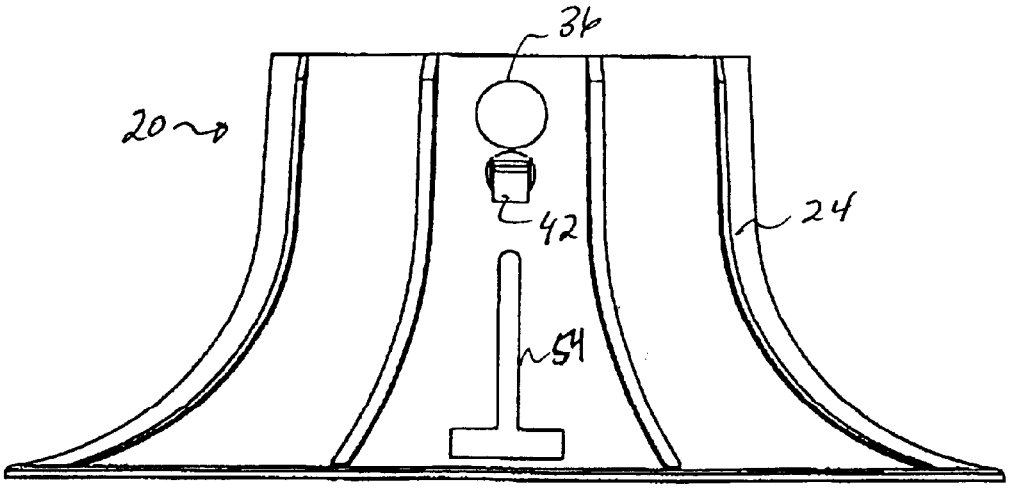
FIG. 7 is a side elevation view of the tree stand of FIG. 6.

The third embodiment drawn in FIGS. 6 and 7 has an opening 54 which also has a long narrow slot but which terminates in a rectangular shaped opening adjacent to the peripheral edge of the skirt 24.

Figure 8:
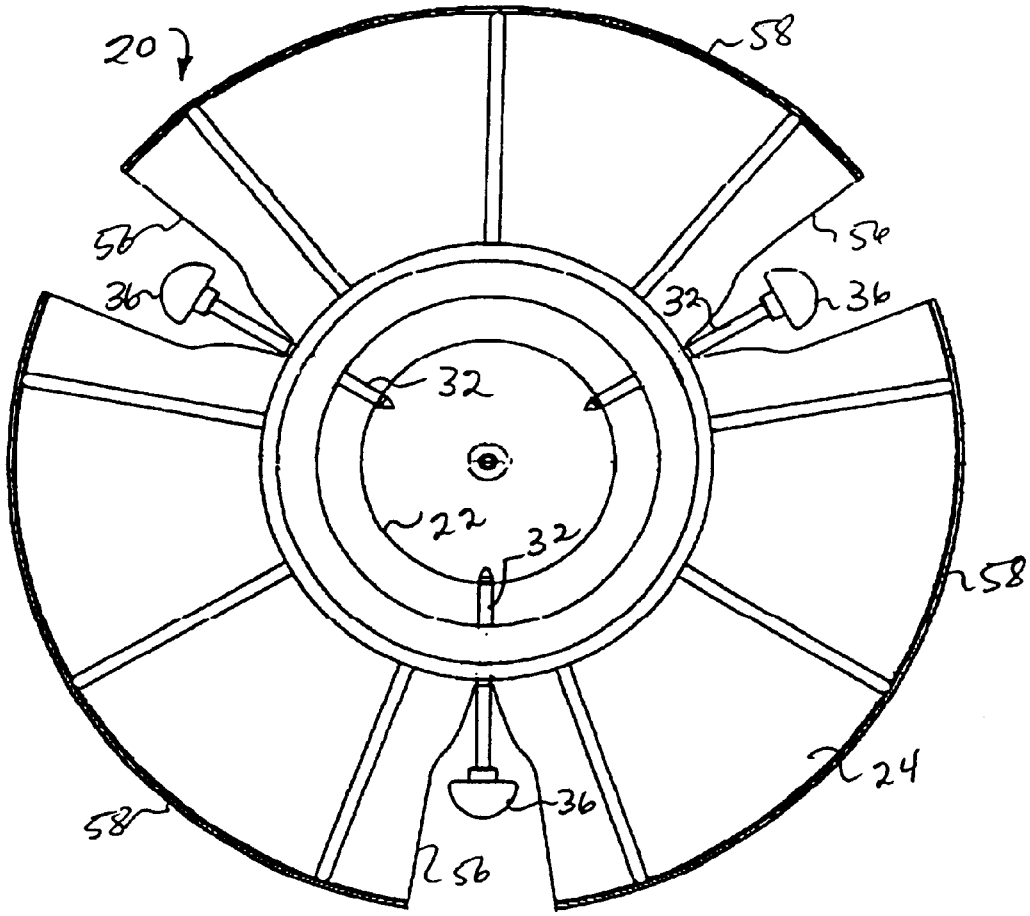
FIG. 8 is a top plan view of a fourth embodiment of the invention.
Figure 9:
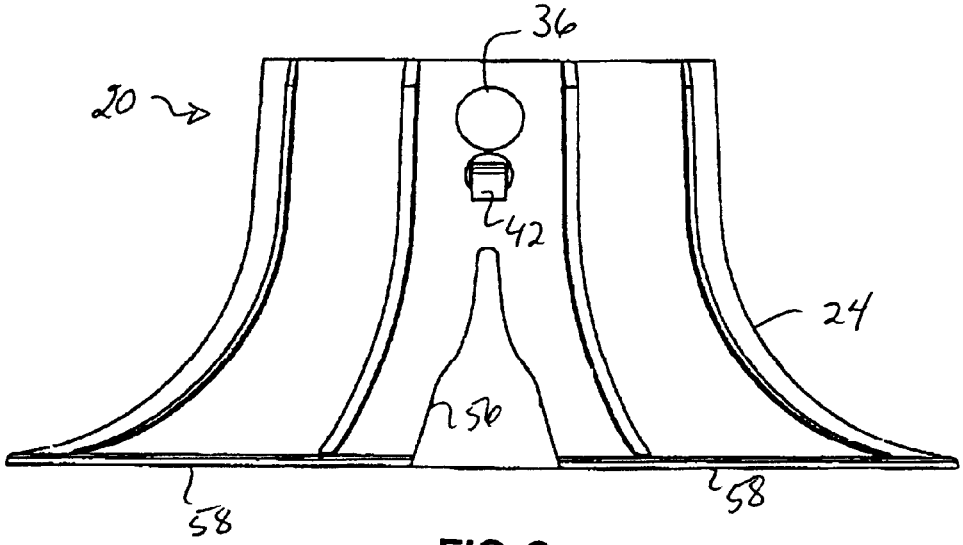
FIG. 9 is a side elevation view of the tree stand of FIG. 8.

A fourth embodiment of the invention is drawn in FIGS. 8 and 9 where it will be seen that the opening, designated by reference numeral 56, comprises an open slot having a wide end and which extends through the perimetric edge of the skirt 24 to form a discontinuity in the peripheral skirt 24 so that the skirt effectively has three "legs" designated by reference numeral 58.

Figure 10:
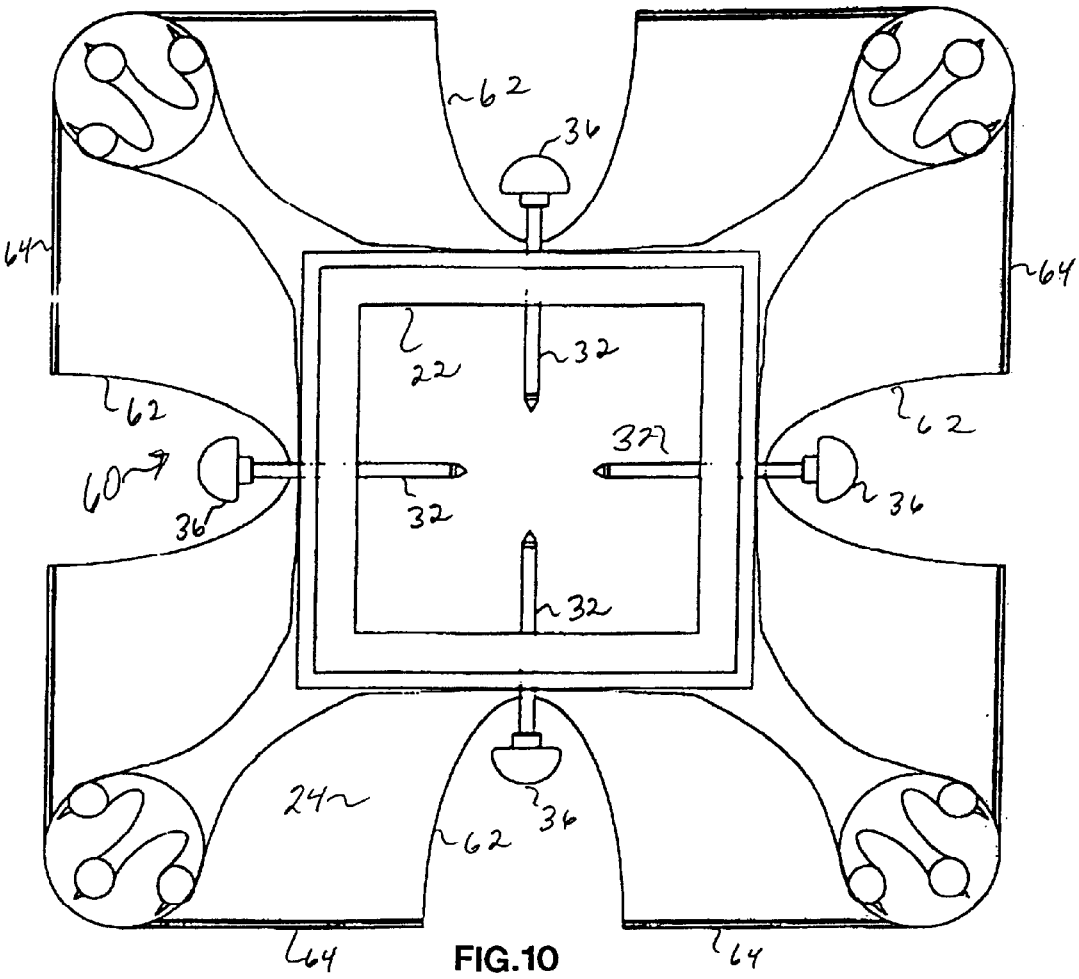
FIG. 10 is a top plan view of a fifth embodiment of the invention.
Figure 11:
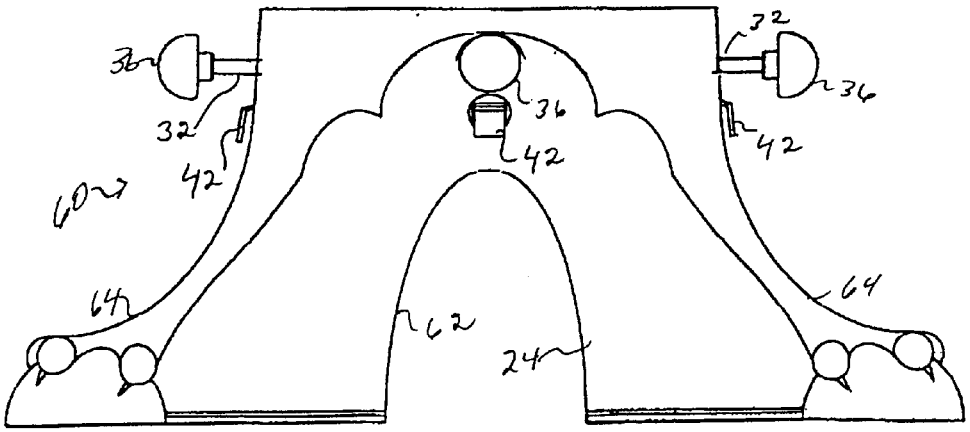
FIG. 11 is a side elevation view of the tree stand of FIG. 10.

A variant of the invention drawn in FIGS. 8 and 9 is shown in FIGS. 10 and 11 where the stand has a generally square configuration, all preceding embodiments having had a circular configuration. Accordingly, the stand 60 drawn in FIG. 10 has four sets of locating pins 32 each associated with a respective slot 62 having a parabolic shape for which the wide end extends through the perimetric edge of the skirt 24 so that it forms four legs 64.

Figure 12:
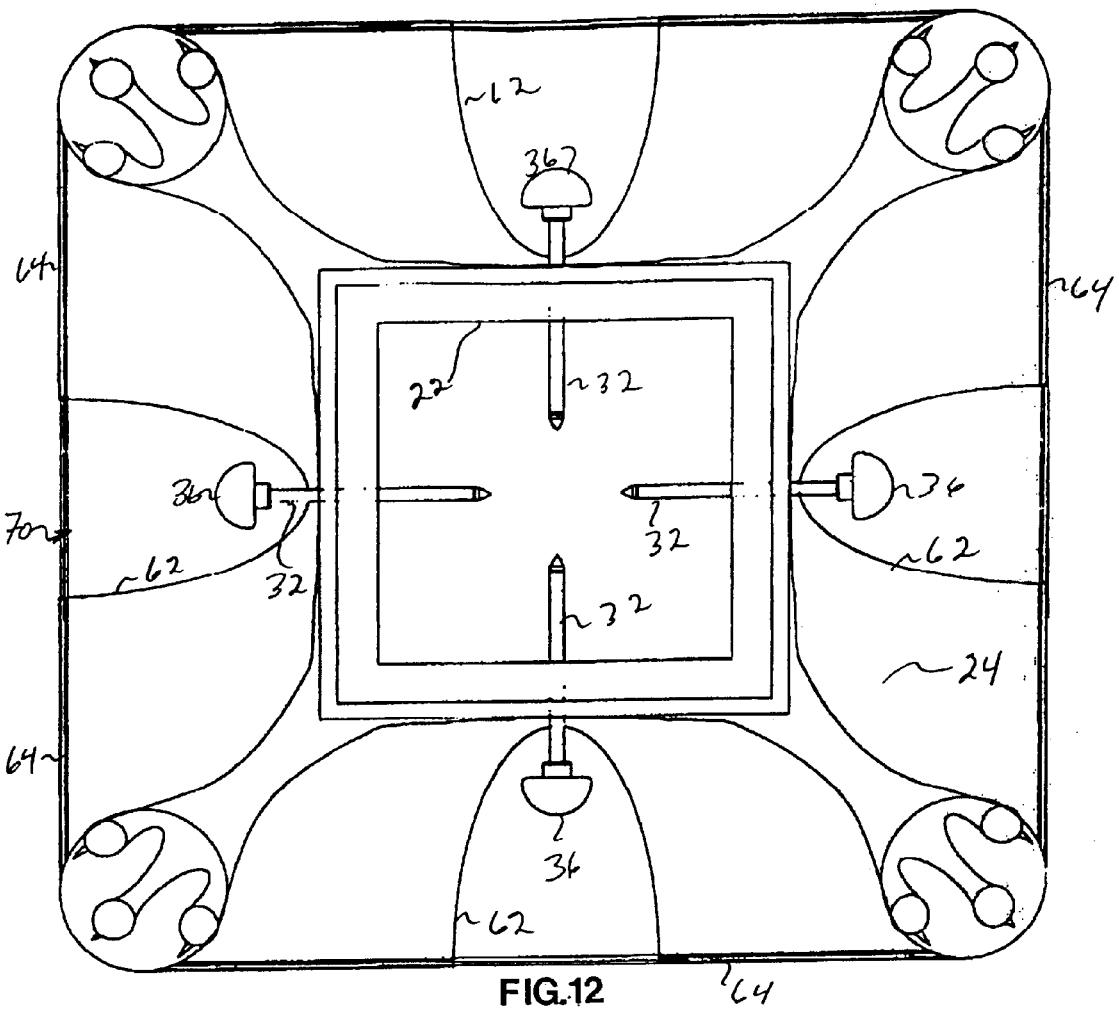
FIG. 12 is a top plan view of a sixth embodiment of the invention.
Figure 13:
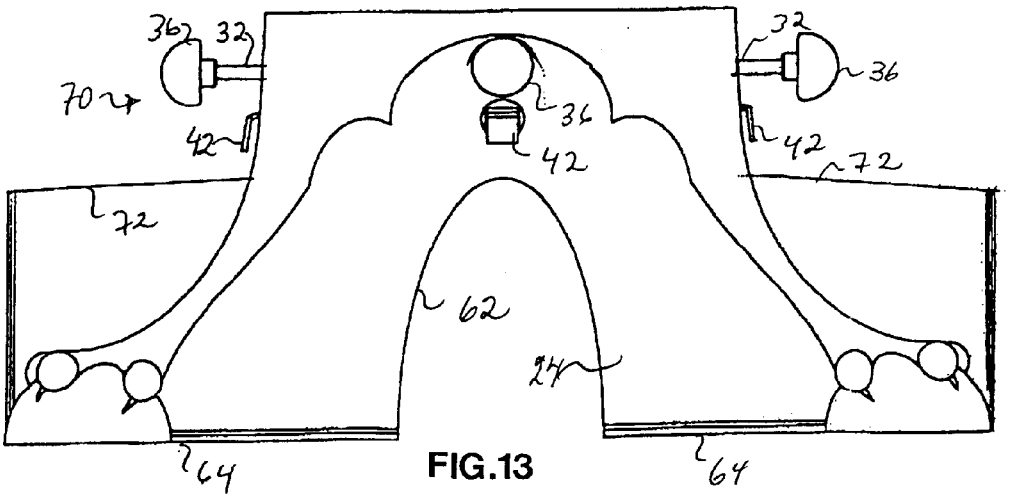
FIG. 13 is a side elevation view of the tree stand of FIG. 12.

In a sixth embodiment of the invention, shown in FIGS. 12 and 13, the stand 70 is similar to the tree stand 60 of FIGS. 10 and 11. However, the legs 64 of the tree stand are secured to each other by a webbing or shroud 72 in order to improve the structural strength of the peripheral skirt 24 while still accommodating the pins 32 of any stacked underlying tree stands. The shroud 72 extends from one side edge of the slot 62 to the other so as to bridge the gap in between. The nature and shape of the shroud 72 may vary considerably, as will be appreciated by those skilled in the art.

Further changes may be made to the shape and configuration of the tree stand itself as well as to the shape of the openings provided for accommodating the hardware.

What is claimed is:

1. In a tree stand having an inner well to contain water for sustaining a cut natural tree, an outer peripheral skirt for buttressing the well and supporting the stand, and a number of fastening assemblies for securing the tree to the stand, each said fastening assembly having a locating pin slidable through respective apertures in the stand for movement between a retracted configuration spaced from the tree and an extended configuration engaging the tree, each said pin having a manipulating knob at an outer end remote from the well, the improvement in which the peripheral skirt has a number of access openings each associated with a respective fastening assembly, the access openings extending longitudinally along a portion of the height of the peripheral skirt from a position adjacent to a respective said locating pin toward a perimetric edge of said skirt wherein the locating pins of underlying nested tree stands may be accommodated so that a plurality of stands may be vertically stacked.

2. Tree stand according to claim 1 in which each access opening is dimensioned to accommodate a respective said manipulating knob at one end remote from said locating pin.

3. Tree stand according to claim 2 in which the access openings have a tear drop shape.

4. Tree stand according to claim 2 in which the access openings have the shape of a keyhole slot comprising a longitudinally extending narrow opening adjacent the locating pin and a wider opening remote from the locating pin.

5. Tree stand according to claim 1 in which the access openings extend through the perimetric edge of the skirt thereby defining a discontinuity in the peripheral skirt.

6. A tree stand having an inner well closed at one end for receiving a cut natural tree and holding water to sustain the tree, an outer peripheral skirt concentric with the well and coupled to the well at an upper end, the skirt extending outwardly from the well to define a base at a lower end having a diameter substantially greater than the well so as to buttress the well and support the stand, a number of fastening assemblies for securing the tree to the stand, each said fastening assembly having a locating pin slidable through respective apertures in the well and the skirt for movement between a retracted configuration spaced from the tree and an extended configuration engaging the tree, each said pin having a manipulating knob at an outer end remote from the well, and a corresponding number of access openings each associated with a respective fastening assembly, the access openings extending longitudinally along a portion of the height of the peripheral skirt from a position adjacent to a respective said locating pin toward a perimetric edge of said skirt wherein the locating pins of underlying nested tree stands may be accommodated so that a plurality of stands may be vertically stacked.

7. Tree stand according to claim 6 in which each access opening is dimensioned to accommodate a respective said manipulating knob at one end remote from said locating pin.

8. Tree stand according to claim 7 in which the access openings have a tear drop shape.

9. Tree stand according to claim 7 in which the access openings have the shape of a keyhole slot comprising a longitudinally extending narrow opening adjacent the locating pin and a wider opening remote from the locating pin.

10. Tree stand according to claim 6 in which the access openings extend through the perimetric edge of the skirt thereby defining a discontinuity in the peripheral skirt.

* * * * *